US010984776B2

(12) United States Patent
Yamkovoy

(10) Patent No.: US 10,984,776 B2
(45) **Date of Patent: *Apr. 20, 2021**

(54) PRESSURE ADAPTIVE ACTIVE NOISE CANCELLING HEADPHONE SYSTEM AND METHOD

(71) Applicant: Bose Corporation, Framingham, MA (US)

(72) Inventor: Paul G. Yamkovoy, Acton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/657,579

(22) Filed: Oct. 18, 2019

(65) Prior Publication Data

US 2020/0051542 A1 Feb. 13, 2020

Related U.S. Application Data

(63) Continuation of application No. PCT/US2018/027520, filed on Apr. 13, 2018, which (Continued)

(51) Int. Cl.
*G10K 11/178* (2006.01)
*H04R 1/10* (2006.01)

(52) U.S. Cl.
CPC ..... *G10K 11/178* (2013.01); *G10K 11/17821* (2018.01); *G10K 11/17833* (2018.01); (Continued)

(58) Field of Classification Search
CPC ... G10K 2210/1081; G10K 2210/3026; G10K 2210/3027; G10K 2210/3028; G10K 2210/3226
(Continued)

(56) References Cited

U.S. PATENT DOCUMENTS

2012/0285242 A1 11/2012 Miyake et al.
2013/0218022 A1* 8/2013 Larsen ..... A61B 5/01 600/474
2014/0314245 A1* 10/2014 Asada ..... H04R 1/1083 381/71.6

FOREIGN PATENT DOCUMENTS

CN 101217828 A 7/2008
CN 102113346 A 6/2011
(Continued)

OTHER PUBLICATIONS

First Chinese Office Action dated May 7, 2020 for Chinese Patent Application No. 2018800260537.
Office Action dated Jul. 23, 2020 for EP Appln. 18722808.5-1210.

*Primary Examiner* — David L Ton

(57) ABSTRACT

Aspects are generally directed to headphone systems that adjust Active Noise Reduction operations based on measurements of environmental conditions. In one example, a headphone system includes an earpiece having an interior volume, the earpiece configured to couple to an ear and define an acoustic volume including the interior volume and a volume within the ear, a speaker to provide acoustic energy to the acoustic volume based on a received driver signal, a feedback microphone to detect at least residual noise within the acoustic volume and generate a feedback audio signal indicative of the residual noise, and a control circuit including a sensor interface configured to receive an atmospheric pressure signal, the control circuit coupled to the feedback microphone to receive the feedback audio signal, and the control circuit configured to adjust the driver signal based at least in part on the feedback audio signal and the atmospheric pressure signal.

20 Claims, 7 Drawing Sheets

Related U.S. Application Data is a continuation of application No. 15/492,462, filed on Apr. 20, 2017, now Pat. No. 10,170,095.

(52) U.S. Cl.
CPC ..... *G10K 11/17881* (2018.01); *H04R 1/1083* (2013.01); *G10K 2210/1081* (2013.01); *G10K 2210/3026* (2013.01); *G10K 2210/3027* (2013.01); *G10K 2210/3028* (2013.01); *G10K 2210/3226* (2013.01); *G10K 2210/503* (2013.01)

(58) Field of Classification Search
USPC ..... 381/74
See application file for complete search history.

(56) References Cited

FOREIGN PATENT DOCUMENTS

| | | | |
|---|---|---|---|
| CN | 102118667 | A | 7/2011 |
| CN | 102414741 | A | 4/2012 |
| CN | 102778836 | A | 11/2012 |
| CN | 102905209 | A | 1/2013 |
| CN | 103269465 | A | 8/2013 |
| CN | 104081789 | A | 10/2014 |
| EP | 2779685 | A1 | 9/2014 |
| GB | 2188210 | A | 9/1987 |

* cited by examiner

PRESSURE ADAPTIVE ACTIVE NOISE CANCELLING HEADPHONE SYSTEM AND METHOD

RELATED APPLICATIONS

This application is a continuation application and claims benefit of International Application No. PCT/US18/27520, filed Apr. 13, 2018, and titled "PRESSURE ADAPTIVE ACTIVE NOISE CANCELLING HEADPHONE SYSTEM AND METHOD", which was an international application filing of U.S. patent application Ser. No. 15/492,462, filed Apr. 20, 2017, and titled "PRESSURE ADAPTIVE ACTIVE NOISE CANCELLING HEADPHONE SYSTEM AND METHOD". The contents of each application are incorporated by reference herein in their entirety.

TECHNICAL FIELD

Aspects and implementations of the present disclosure are directed generally to audio systems, and in some examples, more specifically to systems and methods for Active Noise Reduction (ANR) in headphone systems.

BACKGROUND

Active Noise Reduction (ANR) headphones typically block undesired noise from a listener's ear by generating noise cancelling signals that destructively interfere with the undesired noise. Often the ANR headphones will include one or more microphones that measure the undesired noise. Based on the characteristics of the measured noise, the headphones will generate appropriate noise cancelling signals. The noise cancelling signals, once generated, are radiated by the headphones to reduce the undesired noise in the ear canal of the listener. In many instances, ANR headphones provide an improved listening experience when compared to traditional audio headphones.

SUMMARY

According to various aspects and examples discussed herein, there is provided a headphone system that adjusts Active Noise Reduction (ANR) operations based on detected conditions of the environment in which the headphone system is operating. For example, the detected environmental conditions may include atmospheric pressure, altitude, location, latitude and/or longitude data, speed, and/or temperature. In one example, the headphone system includes an atmospheric pressure sensor that measures an atmospheric pressure of the environment of the headphone system. Once measured, a control circuit coupled to the atmospheric pressure sensor may adjust a feedback and/or feed-forward filter associated with the ANR circuitry of the headphone system to compensate for one or more impacts that the atmospheric pressure may have on ANR performance.

In certain other examples, the headphone system may further include a secondary environmental sensor to further inform when one or more adjustments to the ANR circuitry (e.g., a feedback and/or feed-forward filter) is appropriate. In one example, the headphone system may include an altitude sensor that measures an altitude of the headphone system relative to the earth. Once measured, the control circuit of the headphone system may use the altitude data to confirm that one or more adjustments to the feedback and/or the feed-forward filter are appropriate. Accordingly, in certain examples, other environmental conditions may be similarly monitored and used to instruct the control circuit when to compensate for one or more impacts that the atmospheric pressure may have on ANR performance. Such aspects and examples are particularly beneficial when included in headphone systems designed for aircraft platforms, where changes in pressure may have a significant effect on headphone performance.

In one example, the headphone system comprises an earpiece having an interior volume, the earpiece configured to couple to an ear and define an acoustic volume comprising the interior volume and a volume within the ear, a speaker acoustically coupled to the acoustic volume to provide acoustic energy to the acoustic volume based on a received driver signal, a feedback microphone acoustically coupled to the acoustic volume to detect at least residual noise within the acoustic volume, and generate a feedback audio signal indicative of the residual noise, and a control circuit comprising a sensor interface configured to receive an atmospheric pressure signal, the control circuit coupled to the feedback microphone to receive the feedback audio signal, and the control circuit being configured to adjust the driver signal based at least in part on the feedback audio signal and the atmospheric pressure signal.

As further discussed herein, in some examples, the control circuit is configured to apply a feedback filter to the feedback audio signal to provide a feedback compensating signal. In such an example, the driver signal comprises a combination of at least the feedback compensating signal and an input audio signal. In certain examples, the control circuit is configured to adjust a transfer function of the feedback filter based on the atmospheric pressure signal. In various additional examples, the headphone system further comprises a data store comprising a plurality of feedback filter coefficient sets, and the control circuit is configured to select a first feedback filter coefficient set from among the plurality of feedback filter coefficient sets based on the atmospheric pressure signal.

According to various examples, the sensor interface is further configured to receive an altitude signal, and the control circuit is further configured to adjust the driver signal based at least in part on the altitude signal. The headphone system may further comprise a feed-forward microphone acoustically coupled to an external environment to detect external noise and generate a feed-forward audio signal. In such an example, the control circuit is coupled to the feed-forward microphone to receive the feed-forward audio signal, and the control circuit is further configured to apply a feed-forward filter to the feed-forward audio signal to provide a feed-forward compensating signal. In at least this example, the driver signal comprises a combination of at least the feed-forward compensating signal and an input audio signal. According to various examples, the control circuit is configured to adjust a transfer function of the feed-forward filter based on the atmospheric pressure signal.

In at least one example, the atmospheric pressure signal comprises at least one instantaneous value of an atmospheric pressure, and the control circuit is further configured to compare the instantaneous value to an alarm threshold and generate an alarm signal for the speaker when the instantaneous value exceeds the alarm threshold. In some examples, the sensor interface is further configured to receive aircraft data from an on-board aircraft system sensor, and the control circuit is further configured to adjust the driver signal based at least in part on the aircraft data.

According to some aspects, provided is another headphone system. In one example, the headphone system comprises an earpiece having an interior volume, the earpiece configured to couple to an ear and define an acoustic volume comprising the interior volume and a volume within the ear, a speaker acoustically coupled to the acoustic volume to provide acoustic energy to the acoustic volume based on a received driver signal, a feedback microphone acoustically coupled to the acoustic volume to detect at least residual noise within the acoustic volume and generate a feedback audio signal indicative of the residual noise, a feed-forward microphone acoustically coupled to an external environment to detect external noise and generate a feed-forward audio signal indicative of the external noise, and a control circuit comprising a sensor interface configured to receive an atmospheric pressure signal, the control circuit being configured to adjust the driver signal based at least in part on the feed-forward audio signal, the feedback audio signal, and the atmospheric pressure signal.

As further discussed herein, in certain examples, the control circuit is configured to apply a feed-forward filter to the feed-forward audio signal to provide a feed-forward compensating signal, and further configured to apply a feedback filter to the feedback audio signal to provide a feedback compensating signal. In at least these examples, the driver signal comprises a combination of at least the feed-forward compensating signal, the feedback compensating signal, and an input audio signal. In certain examples, the control circuit is configured to adjust a transfer function of the feedback filter based on the atmospheric pressure signal.

According to various examples, the headphone system further comprises a data store comprising a plurality of feedback filter coefficient sets. In at least these examples, the control circuit is configured to select a first feedback filter coefficient set from among the plurality of feedback filter coefficient sets based on the atmospheric pressure signal. In at least one example, the control circuit is further configured to adjust a transfer function of the feed-forward filter based on the atmospheric pressure signal. According to various examples, the headphone system further comprises a data store comprising a plurality of feed-forward filter coefficient sets. In at least these examples, the control circuit is configured to select a first feed-forward filter coefficient set from among the plurality of feed-forward filter coefficient sets based on the atmospheric pressure signal. In various examples, the sensor interface is further configured to receive an altitude signal, the control circuit being further configured to adjust the driver signal based at least in part on the altitude signal.

According to an aspect, provided is a method for operating a headphone system. In one example, the method includes acts of providing acoustic energy from a speaker of a headphone system to an acoustic volume based on a driver signal received at the speaker, detecting at least residual noise within the acoustic volume and generating a feedback audio signal indicative of the residual noise, with a feedback microphone positioned within the headphone system, receiving an atmospheric pressure signal from an atmospheric pressure sensor, and adjusting the driver signal based at least in part on the feedback audio signal and the atmospheric pressure signal.

As further discussed herein, in certain examples, the method may further comprise applying a feedback filter to the feedback audio signal to provide a feedback compensating signal. In at least these examples, the driver signal comprises a combination of at least the feedback compensating signal and an input audio signal. In certain examples, the method may further comprise adjusting a transfer function of the feedback filter based on the atmospheric pressure signal. In some examples, the method may further comprise selecting a first feedback filter coefficient set from among a plurality of feedback filter coefficient sets based on the atmospheric pressure signal, and applying the first feedback filter coefficient set to the feedback filter.

According to certain examples, the method further comprises receiving an altitude signal, and adjusting the driver signal based at least in part on the altitude signal. In some examples, the method further comprises detecting external noise and generating a feed-forward audio signal indicative of the external noise, with a feed-forward microphone positioned within the headphone system, and adjusting the driver signal based at least in part on the feed-forward audio signal.

In various examples, the method further comprises applying a feed-forward filter to the feed-forward audio signal to provide a feed-forward compensating signal. In at least these examples, the driver signal comprises a combination of at least the feed-forward compensating signal and an input audio signal. The method may further comprise adjusting a transfer function of the feed-forward filter based on the atmospheric pressure signal, in some examples. According to certain examples, the method further comprises selecting a first feed-forward filter coefficient set from among a plurality of feed-forward filter coefficient sets based on the atmospheric pressure signal, and applying the first feed-forward filter coefficient set to the feed-forward filter.

Still other aspects, examples, and advantages of these exemplary aspects and examples are discussed in detail below. Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example. Various aspects and examples described herein may include means for performing any of the described methods or functions.

BRIEF DESCRIPTION OF THE DRAWINGS

Various aspects of at least one example are discussed below with reference to the accompanying figures, which are not intended to be drawn to scale. The figures are included to provide illustration and a further understanding of the various aspects and examples, and are incorporated in and constitute a part of this specification, but are not intended as a definition of the limits of the disclosure. In the figures, each identical or nearly identical component that is illustrated in various figures is represented by a like numeral. For purposes of clarity, not every component may be labeled in every figure. In the figures.

DETAILED DESCRIPTION

Figure 1:
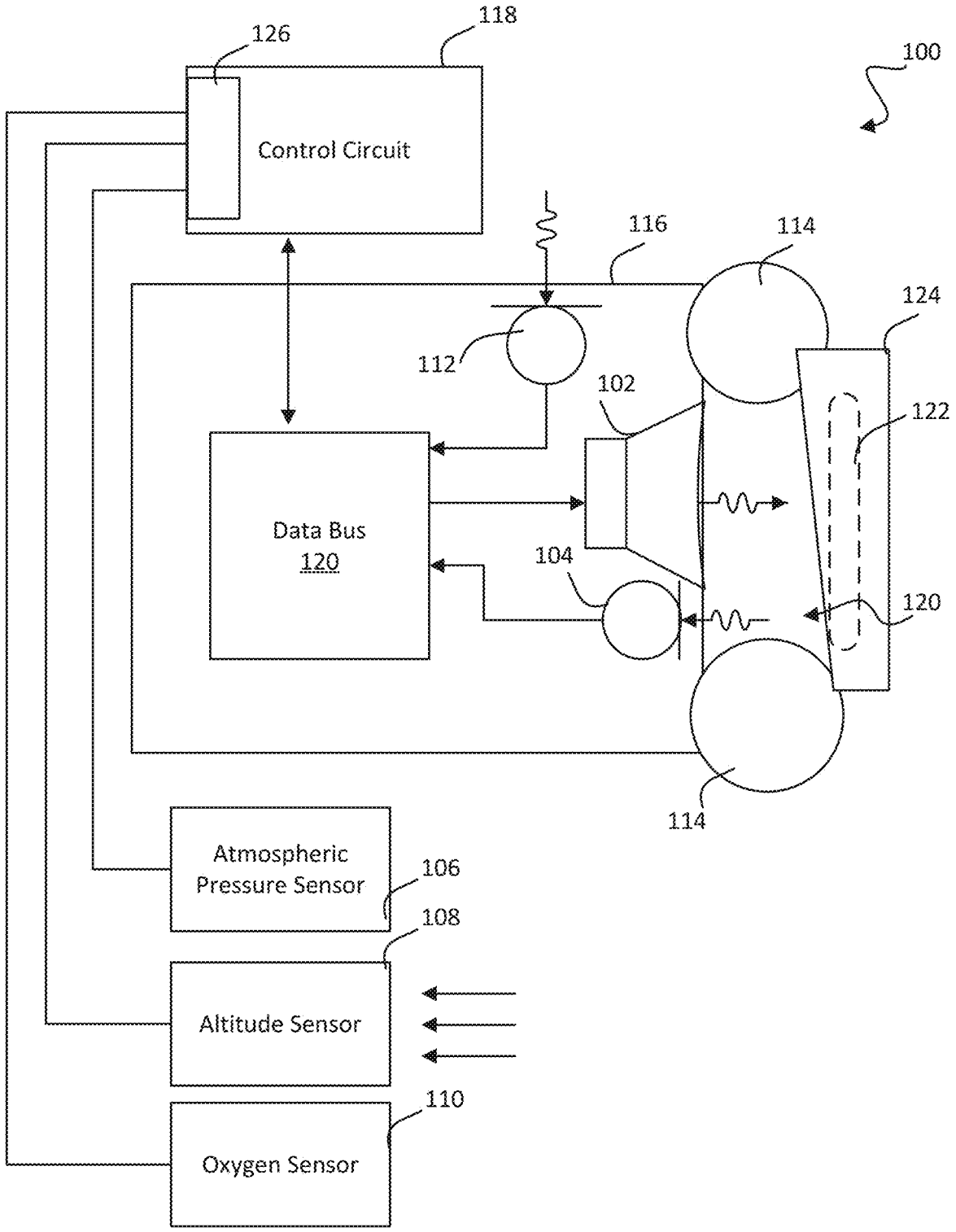
FIG. 1 is a block diagram of a headphone system according to various examples discussed herein.

Various aspects and examples discussed herein are directed to headphone systems that adjust Active Noise Reduction (ANR) operations based on measurements of atmospheric pressure, altitude, and/or other environmental conditions.

As discussed above, ANR headphones typically mask undesired noise at a listener's ear by generating cancelling signals that destructively interfere with the undesired noise. Noise cancelling functionality is desirable in various types of headphone systems, such as those designed for consumer products and those designed for commercial applications. In many instances, it is desirable to incorporate ANR technology within an aviation headphone system. In particular, ANR functionality allows a pilot, co-pilot, or passenger to perceive important audio content that may otherwise be obscured or masked by external noise and/or residual noise within the system.

According to certain aspects, examples of the headphone system described herein are designed for an aircraft platform. For instance, the headphone system may be designed for use in aircrafts that fly at altitudes of up to 40,000 or 45,000 feet (approximately 12,190 to 13,710 meters) and may require more than one pilot. Unfortunately, aircrafts that fly at these altitudes can experience a loss of pressure for a variety of reasons, such as, technical faults within the pressurization system, cracks or leaks within the fuselage or aircraft windows, and faulty seals, to name a few. Depending on the severity of the issue, a loss of cabin pressure may be slow or sudden and may depend on the particular reason for the failure. Whether slow or sudden, losses in pressure can impact ANR performance and, in some instances, may cause ANR circuitry of the headphone system to become unstable. Moreover, in extreme cases, these pressure losses may even impede the pilots' ability to communicate properly and/or safely operate the aircraft.

In addition to the influence of aircraft faults on headphone system ANR performance, changing aircraft conditions during various phases of flight (e.g., take-off, landing, in-flight, and taxiing) may demand different performance parameters from the ANR technology. For example, the exposure of a pilot to external noise may be significantly greater when the aircraft is taking off than when the aircraft is at cruising altitude. Accordingly, a single set of ANR operating parameters is often inadequate to effectively compensate for external noise during all phases of flight.

As such, various aspects and examples discussed herein are directed to a headphone system that includes one or more sensors to monitor environmental conditions and/or a state of an aircraft. Each sensor may be integrated within a headphone structure of the system, or may be located external to the headphone structure and may communicate with components of the headphone system via a sensor interface. For example, the sensor(s) may be incorporated within an on-board aircraft system, integrated within a navigation system, or integrated within a device connected to the headphone system, such as a mobile phone or tablet computer. Signals received from each sensor are used to determine the appropriate settings for ANR circuitry of the headphone system. That is, the headphone system may select one or more settings for the ANR circuitry to accommodate for one or more influences that the environmental conditions and/or a state of the aircraft may have on ANR performance. Accordingly, one or more adjustments to the ANR circuitry may adapt to prevent an unstable condition in the ANR circuitry and/or to substantially mask residual noise and/or external noise that would render the audio content delivered by the headphone structure substantially inaudible.

As further discussed herein, the headphone system may include, or may be coupled to, sensors that detect one or more of atmospheric pressure, altitude relative to earth, external noise level, location, latitude and/or longitude data, aircraft speed, temperature outside the aircraft, and aircraft data, among various other environmental conditions. Accordingly, various aspects and examples provide improved noise cancellation functionality that is not currently available in ANR headphone systems.

It is to be appreciated that examples of the systems and methods discussed herein are not limited in application to the details of construction and the arrangement of components set forth in the following description or illustrated in the accompanying drawings. The methods and apparatuses are capable of implementation in other examples and of being practiced or of being carried out in various ways. Examples of specific implementations are provided herein for illustrative purposes only and are not intended to be limiting. Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation.

Though the elements of several views of the drawings herein may be shown and described as discrete elements in a block diagram and may be referred to as "circuit" or "circuitry," unless otherwise indicated, the elements may be implemented as one of, or a combination of, analog circuitry, digital circuitry, or one or more microprocessors executing software instructions. For example, software instructions may include digital signal processing (DSP) instructions to be executed by a digital signal processor. Unless otherwise indicated, signal lines may be implemented as discrete analog or digital signal lines, as a single discrete digital signal line with appropriate signal processing to process separate streams of audio signals, or as elements of a wireless communication system.

Some of the processing operations discussed herein may be expressed in terms of generating, determining, adjusting, filtering, distinguishing, and/or controlling, to name a few. The equivalent of determining, adjusting, filtering, comparing, selecting, and/or controlling can be performed by either analog or digital signal processing techniques and are included within the scope of this disclosure. Unless otherwise indicated, audio signals may be encoded in either digital or analog form; conventional digital-to-analog or analog-to-digital converters may not be shown in the figures but are intended to be within the scope of this disclosure.

Referring to FIG. 1, illustrated is a block diagram of a headphone system 100 according to examples discussed herein. As shown, the headphone system 100 includes at least one speaker 102, at least one microphone, such as the illustrated feedback microphone 104 and feed-forward microphone 112, one or more environmental sensors (e.g., an atmospheric pressure sensor 106, an altitude sensor 108, and/or an oxygen sensor 110), one or more ear-cushions 114, an earpiece 116, and a control circuit 118. In response to receiving an input audio signal from an audio source, the headphone system 100 is configured to generate and provide a driver signal to the speaker 102. Once received at the speaker 102, the speaker 102 converts the driver signal to corresponding acoustic energy to deliver audio content to a listener positioned proximate the headphone system 100 (e.g., a user wearing the headphone system 100). In various examples, the speaker 102 delivers the acoustic energy to an acoustic volume that consists of an interior volume 120 of the earpiece 116 and a volume 122 within an ear 124 of the listener. As illustrated in FIG. 1, the earpiece 116 may be in contact with the ear 124 of the listener at the ear-cushions 114. However, in other examples, the ear-cushions 114 may be in contact with the head of the listener or within the pinna of the ear 124 of the listener. This may be the case in examples in which the headphone system 100 utilizes an in-ear earpiece or earbuds.

According to various examples, the structure of the headphone system 100, including the ear-cushions 114, may provide some degree of Passive Noise Reduction (PNR) by mechanically isolating the listener (e.g., the listener's ear 124) from external noise in the environment of the headphone system 100. As discussed herein, external noise may include any undesired acoustic energy that destructively interferes with the acoustic energy delivered to the listener. Within an aircraft environment, such noise may include cabin noise, aircraft noise, wind noise and/or weather noise, and/or speech content, to name a few examples.

In some examples the headphone system 100 may include an in-ear headphone structure where the ear-cushions 114 are positioned to create a seal on an inside of the listener's ear 124 and passively isolate the ear from the external noise. However, in certain other examples, the headphone system 100 may include an over-the-ear or an around-the-ear type headphone structure with the ear-cushions 114 positioned on an ear-cup and configured to sit on top of or enclose the ear 124 to isolate the ear 124 from external noise. While shown in FIG. 1 as including a single speaker, in various examples the speaker 102 may include a set of speakers (e.g., a speaker array). Moreover, in certain examples the headphone system 100 may include a pair of speakers 102 (or speaker sets) and ear-cushion 114 sets; one for each ear of the listener. Various other examples of headphone arrangements, assemblies, and structures that provide some degree of PNR are discussed below with reference to FIG. 4 and FIG. 5.

In addition to the impact of PNR on the external noise, in various examples the headphone system 100 may use the feedback microphone 104 and/or the feed-forward microphone 112 to generate a driver signal that is adjusted to compensate for the external noise and/or residual noise. While shown in FIG. 1 as including both a feedback microphone 104 and a feed-forward microphone 112, it is appreciated that in certain examples the headphone system 100 may include just the feedback microphone 104 or just the feed-forward microphone 112. As illustrated, the feedback microphone 104 may be positioned proximate the ear 124 (e.g., proximate the ear canal) of the listener and may detect the acoustic energy delivered by the speaker 102 to the acoustic volume, as well as, residual external noise (e.g., noise that is not eliminated by the PNR described above or by feed-forward ANR techniques) within the acoustic volume. Based on the detected acoustic energy and residual noise, the feedback microphone 104 generates a feedback audio signal that is communicated to the control circuit 118 (e.g., via the data bus 120). As further discussed herein, the feedback microphone 104 may be used as a feedback loop with the control circuit 118 to monitor and adjust the driver signal based on the detected acoustic energy and the residual noise. In particular, the control circuit 118 may apply a feedback filter to the feedback audio signal to provide a feedback compensating signal that is combined with the input audio signal to provide a driver signal that compensates for the residual noise within the acoustic volume.

In various examples, the feed-forward microphone 112 also improves the ANR performance of the headphone system 100. As discussed, the feed-forward microphone 112 may be used in combination with the feedback microphone 104, or, in other examples, as an alternative to the feedback microphone 104. As illustrated in FIG. 1, the feed-forward microphone 112 may be positioned within the headphone system 100 to detect external noise from the environment of the headphone system 100. For instance, the feed-forward microphone 112 may be positioned on an exterior surface of the headphone system 100 or in another exposed position from which the feed-forward microphone 112 can detect the external noise before it reaches the ear 124 of the listener. Based on the detected external noise, the feed-forward microphone 112 may generate a feed-forward audio signal that is communicated via the data bus 120 to the control circuit 118. While shown in FIG. 1 as a single control circuit 118, in various other examples each of the feedback microphone 104 and the feed-forward 112 microphone may have a dedicated control circuit 118. Each dedicated control circuit may be integrated within the corresponding microphone, integrated within the earpiece 116, or integrated within the control circuit 118. The data bus 120 includes any suitable communication system, such as an electrical bus including a plurality of electrical wires arranged in parallel and/or in serial connection.

Since the feed-forward microphone 112 is positioned to detect the external noise before the noise is perceived by the listener, in various examples the feed-forward microphone 112 may be used as a feed-forward loop with the control circuit 118 to monitor and adjust the driver signal based on the detected external noise. In particular, the control circuit 118 may apply a feed-forward filter to the feed-forward audio signal to provide a feed-forward compensating signal that is combined with the input audio signal to provide a driver signal that compensates for the external noise.

As discussed, in certain examples each of the feedback microphone 104 and the feed-forward microphone 112 may be used in combination with the control circuit 118 to provide a feedback compensating signal and a feed-forward compensating signal that, when combined with the input audio signal, generate a driver signal that compensates for effects that the external noise and/or the residual noise may have on the intelligibility of the audio content delivered to the listener. In one example, the control circuit 118 includes one or more feedback filters and one or more feed-forward filters. The feedback filters and feed-forward filters may be an analog filter or a digital filter implanted within ANR circuitry of the headphone system 100. For instance, the feedback filters and/or feed-forward filters may include linear and time-invariant filters. Each filter may be applied to the corresponding feedback audio signal or feed-forward audio signal to provide a compensating signal. For instance, the feedback filter may be applied by the control circuit 118 (e.g., ANR circuitry of the control circuit 118) to the feedback audio signal to provide a feedback compensating signal, and the feed-forward filter may be applied by the control circuit 118 (e.g., ANR circuitry of the control circuit 118) to the feed-forward audio signal to provide a feed-forward compensating signal.

To generate a driver signal that is adjusted to compensate for the external noise and/or the residual noise, the control circuit 118 may combine the feedback compensating signal and/or the feed-forward compensating signal with the input audio signal. It is appreciated that a combination of the feedback compensating signal and the input audio signal provides a driver signal that is adjusted to compensate for the external residual noise, and a combination of the feed-forward compensating signal and the input audio signal provides a driver signal that is adjusted to compensate for at least the external noise. Accordingly, an example of the headphone system 100 that includes both a feedback microphone 104 and a feed-forward microphone 112 offers the benefit of complete ANR. Each feedback filter and feed-forward filter may be described by a corresponding transfer function and filter coefficients that define the gain, phase, and frequency response of the feedback filter or the feed-forward filter. The performance of each feedback filter or feed-forward filter may be adjusted by changing the transfer function and/or the one or more filter coefficients associated with that feedback filter or feed-forward filter.

As discussed above, in some instances changing environmental conditions may have an impact on the performance of the headphone system 100, and in particular, ANR circuitry (e.g., feedback filter(s) and feed-forward filter(s)) within the control circuit 118. For example, in a situation where there is a sudden loss in pressure, the speed of sound will decrease as a result of a decrease in the density of the medium that the sound is propagating through. This will result in an increased delay between the speaker 102 and the feedback microphone 104, which can lead to instability in the ANR circuitry. Such instability can manifest itself as an objectionable noise, such as a high energy squeal in the earpiece 116, which will impede on a listener's ability to communicate or effectively operate an aircraft.

To accommodate environmental conditions, and in particular, rapid changes in environmental conditions, the headphone system 100 may detect the environmental conditions using the one or more environmental sensors illustrated in FIG. 1. While FIG. 1 shows the headphone system 100 as including each of an atmospheric pressure sensor 106, an altitude sensor 108, and an oxygen sensor 110, various other implementations may be limited to a single environmental sensor. However, in other examples, the headphone system 100 may include any sub-combination of the illustrated environmental sensors, such as the atmospheric pressure sensor 106 and the oxygen sensor 110, or the altitude sensor 108 and the oxygen sensor 110. Moreover, still other examples of the headphone system 100 may include other types of environmental sensors that are not explicitly illustrated in FIG. 1 but intended to be within the scope of this disclosure. For example, the headphone system 100 may include one or more sensors that detect one or more of external noise level, location, latitude and/or longitude data, aircraft speed, temperature outside the aircraft, and aircraft data, among various other environmental conditions. As further discussed below with reference to at least FIG. 3, environmental sensors may be integrated within the headphone structure, such as the earpiece 116, and/or may be positioned external to the headphone structure (e.g., incorporated within an on-board aircraft system or a connected device, such as a mobile phone) and communicate with control circuit 118 via the sensor interface 126, which may be a wired or wireless connection.

In certain examples, the atmospheric pressure sensor 106 may measure an atmospheric pressure and generate a corresponding atmospheric pressure signal (also referred to herein as "pressure signal"). The atmospheric pressure sensor 106 may communicate the pressure signal to the control circuit 118 via the sensor interface 126. Atmospheric pressure measurements may be discrete, periodic, or continuous, depending on the specific implementation. In particular, continuous atmospheric pressure measurements performed by the atmospheric pressure sensor 106 offers the benefit of dynamic (e.g., in real-time) performance adjustments. In one example, the atmospheric pressure sensor 106 is a barometric pressure sensor.

Figure 2:
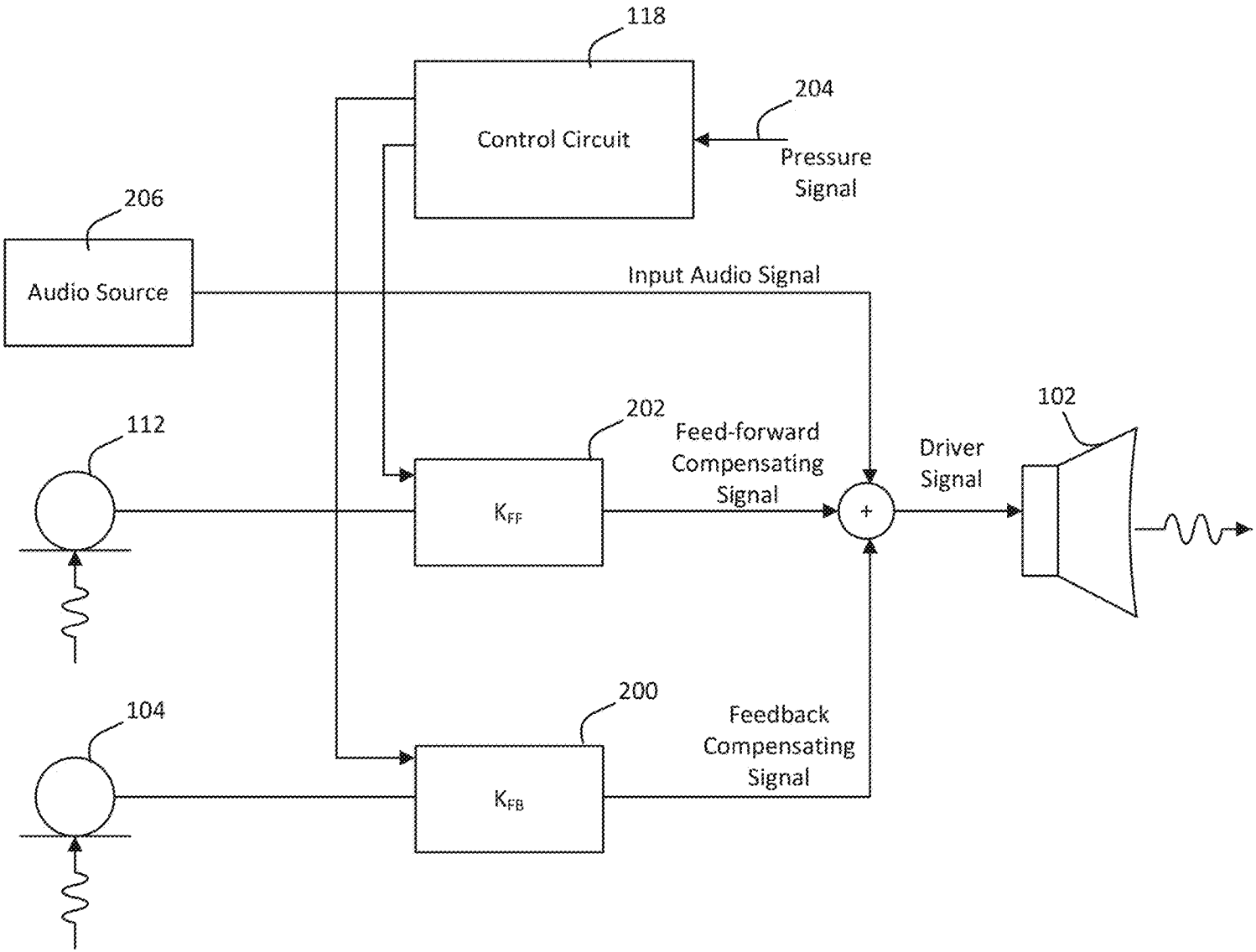
FIG. 2 is a block diagram showing adjustments to a feedback filter and a feed-forward filter based on an environmental sensor signal, according to various examples discussed herein.

Based on the received pressure signal, the control circuit 118 may make one or more adjustments to the ANR circuitry (e.g., the feedback filter(s) and/or feed-forward filter(s)) to effect a change in the driver signal and the acoustic energy delivered to the listener. In particular, the control circuit 118 may adjust the feedback filter(s) and/or feed-forward filter(s) to compensate for the effects of the measured atmospheric pressure on ANR operations. Referring to FIG. 2, illustrated is a block diagram showing adjustments to a feedback filter 200 ("$K_{FB}$") and a feed-forward filter 202 ("$K_{FF}$") based on an environmental sensor signal 204, according to various examples. FIG. 2 is described within continuing reference to the headphone system 100 of FIG. 1.

In FIG. 2, an atmospheric pressure signal is received from the atmospheric pressure sensor 106 at the control circuit 118 (e.g., pressure signal 204). Based on a value of the atmospheric pressure signal, the control circuit 118 adjusts a transfer function and/or filter coefficient(s) of the feedback filter 200 and/or a transfer function and/or filter coefficient(s) of the feed-forward filter 202 to compensate for one or more effects of the atmospheric pressure on ANR operations. The resulting feed-forward compensating signals and feedback compensating signal are combined with an input audio signal from an audio signal source 206 to provide a driver signal that is adjusted based on the pressure signal. As illustrated, the driver signal may be delivered to the speaker 102 to radiate corresponding acoustic energy to the listener.

In one example, adjustments to the feedback and/or feed-forward filters 200, 202 may be based on an instantaneous value of the atmospheric pressure. For instance, the control circuit 118 may compare the atmospheric pressure to a threshold, and adjust the transfer functions and/or filter coefficient(s) of the feedback and/or feed-forward filters 200, 202 if the instantaneous value exceeds the threshold. If the instantaneous value fails to exceed the threshold, the control circuit 118 may continue in its current state of ANR operation. In certain other examples, the control circuit 118 may compare the instantaneous atmospheric pressure to a range of thresholds, each threshold corresponding to a particular level of adjustment. Based on the comparison, the control circuit 118 selects and applies the appropriate level of adjustment to the transfer function and/or filter coefficient(s) of the feedback and/or feed-forward filters 200, 202. In still other examples, the adjustments to the feedback and/or feed-forward filters 200, 202 may be based on an average of the atmospheric pressure over a predetermined period of time or a rate of change of the atmospheric pressure over a predetermined period of time. The average atmospheric pressure and/or the rate of change may be compared to a threshold or a range of thresholds in a manner similar to that discussed with reference to the instantaneous atmospheric pressure value. Based on the comparison, the control circuit 118 selects and applies the appropriate level of adjustment.

Adjustments to the feedback and/or feed-forward filters 200, 202 may be performed by the control circuit 118 continuously, and in real-time, with the receipt of the pressure signal. While in various implementations, any suitable technique may be used to adjust the feedback and/or feed-forward filter 200, 202 and generate the driver signal, in certain examples the control circuit may adjust one or more of a gain, phase, or frequency response that defines the feedback filter 200 or the feed-forward filter 202. Specifically, based on one or more values of the pressure signal, the control circuit 118 may select and apply a filter coefficient set that specifies one or more of the gain, phase, or the frequency response. For instance, the ANR circuitry of the control circuit 118 may select one or more filter coefficients to increase or decrease the gain of the feedback and/or feed-forward filter 200, 202 to meet a gain margin constraint for stability. In some instances, this may include increasing a gain of the feedback and/or feed-forward filter 200, 202 to compensate for effects of pressure on the ANR performed by the control circuit 118. In certain other instances, the control circuit 118 may decrease a gain of the feedback and/or feed-forward filter 200, 202 to compensate for the effects of pressure on the ANR operations performed by the control circuit 118. The gain adjustments may be frequency dependent. That is, the gain may be increased in certain frequency ranges and decreased in other frequency ranges.

In certain other instances, the control circuit 118 may adjust one or more filter coefficients to adjust a phase or frequency response of the feedback and/or feed-forward filter 200, 202 to provide a frequency response that will not result in ANR instability of the headphone system 100. That is, in addition to (or alternative to) adjusting a gain of the feedback and/or feed-forward filter 200, 202 to compensate for atmospheric pressure conditions, the control circuit 118 may regulate a phase of the feedback and/or feed-forward filter 200, 202 as a function of frequency based on one or more received atmospheric pressure values.

In certain examples, the control circuit 118 may select between one or more control settings for the control circuit 118 based on a given pressure signal. In further examples, the control circuit 118 may also select one or more filter settings for the feed-forward loop and/or the feedback loop. For instance, the control circuit 118 may select a transfer function or a set of filter coefficients for the feedback filter and/or feed-forward filter 202. Customized filter settings offer improved performance when compared to generic headphone system controller operation. Often, operation of a generic controller must be stable across a wide variety of operating conditions, and consequently, offers limited performance for any particular operating condition. In some instances, such as extreme pressure loss conditions, a generic controller operation may be undesirable and may cause system instability. Accordingly, in addition to improving safety, customized control settings and filter settings provide increased performance and stability.

As discussed, based on the received signal(s) from the environmental sensor(s), the control circuit 118 may select the filter settings that best cancel the external noise given the detected environmental conditions, while also operating the ANR system in a manner that reduces or prevents the system from being rendered unstable. In one example, the control circuit 118 is in communication with a data store, which stores a plurality of different filter settings. For instance, the headphone system 100 may include a memory that stores a look-up table of filter settings. Based on the received pressure signal, the control circuit 118 may execute a filter settings selection routine configured to select the filter settings that best addresses the received signal values. As discussed herein, in at least one example the filter settings may include one or more filter coefficient sets. For instance, the control circuit 118 may select an appropriate feedback filter coefficient set from among a plurality of feedback filter coefficient sets, and/or may select an appropriate feed-forward filter coefficient set from among a plurality of feed-forward filter coefficient sets. Once retrieved from the memory, the control circuit is configured to apply the appropriate filter coefficient set to the corresponding feedback filter 200 or feed-forward filter 202 to adjust the gain, phase, and/or frequency response thereof.

In other examples, the memory may further store a look-up table of transfer functions for the feedback filter 200 and/or the feed-forward filter 202. Based on the received pressure signal, the control circuit 118 may execute a transfer function selection routine configured to select the transfer function that best addresses the received values. That is, the data store may store a plurality of transfer functions each of which is designed to address a particular atmospheric pressure condition.

In certain examples, different entries within the look-up table of filter settings and look-up table of transfer functions may correspond to different phases of flight mode of operation (e.g., take-off, landing, in-flight, and taxiing) of an associated aircraft platform. In one example, the control circuit 118 is configured to identify a phase of flight of the aviation platform based on the pressure signal and/or other environmental sensor signals and select the corresponding mode of operation. For instance, in response to receiving an altitude signal having a value between 40,000 and 45,000 feet (approximately between 12,190 and 13,710 meters), the control circuit 118 may select a mode of operation that corresponds to in-flight cruising altitude. Each mode of operation may specify different filter coefficients and/or different transfer functions tailored to the environmental conditions unique to that phase of flight.

Referring to FIG. 1, in certain examples the headphone system 100 may use one or more signals from the other environmental sensors to confirm that one or more adjustments to ANR operations of the headphone system 100 are appropriate given the current environmental conditions. That is, the headphone system 100 may use one or more signals from the other environmental sensors (e.g. the altitude sensor 108) to confirm that current environmental conditions demand an adjustment to the ANR circuitry (e.g., the feedback filter 200 and/or the feed-forward filter 202 illustrated in FIG. 2).

For example, in some instances the atmospheric pressure sensor 106 may generate one or more readings that indicate the ANR operations should be adjusted, while other sensors indicate that ANR operations should not be adjusted. If the control circuit 118 relies solely on the readings from the atmospheric pressure sensor 106, the control circuit 118 may unnecessarily adjust the ANR operations, leading to unnecessarily diminished ANR performance or, in some instances, to a state that would render the ANR system unstable. For example, some atmospheric pressure sensors within an aircraft may measure a sudden change in atmospheric pressure when a cabin door is closed, even though the associated aircraft is still on the ground. In one example, to prevent such a false trigger from unnecessarily disturbing ANR performance, and to add an additional level of stability to the headphone system 100, signals from the other environmental sensors (e.g., the altitude sensor 108 illustrated in FIG. 1) may be used to further inform the control circuit 118 when one or more adjustments to the ANR circuitry are appropriate.

According to various examples, the altitude sensor 108 measures an altitude of the headphone system 100 relative to the earth and generates a corresponding altitude signal. The altitude sensor 108 may communicate the altitude signal to the control circuit 118 via the sensor interface 126, for example. Similar to the atmospheric pressure measurements, altitude measurements may be discrete, periodic, or continuous, depending on the specific implementation. According to certain examples, the altitude sensor 108 is any suitable digital or analog altimeter. The altitude sensor 108 may be a single stand-alone sensor integrated within the associated headset, or in other examples, be incorporated with other sensors (e.g., the pressure sensor 106 and/or an on-board aircraft system).

As discussed herein, in many examples the control circuit 118 makes one or more feedback filter and/or feed-forward filter adjustments when an instantaneous value of the atmospheric pressure, or a rate of change of the atmospheric pressure, exceeds one or more thresholds. In many instances, these thresholds are set at a level that indicates when environmental conditions necessitate an adjustment to current ANR operations. In certain examples, the control circuit 118 may delay these adjustments until an instantaneous value of the altitude, or a rate of change of the altitude, also exceeds one or more similar thresholds. That is, the control circuit 118 may wait until both a value of atmospheric pressure and a value of the altitude exceed thresholds, prior to adjusting the feedback filter and/or feed-forward filter as described herein. In such a manner, the adjustments to the feedback and/or feed-forward filters 200, 202 may be based on an independent comparison of an instantaneous value of the altitude, or a rate of change of the altitude, to one or more thresholds. While discussed in one example as an instantaneous value or a rate of change of an altitude signal, in various other examples similar processes may be executed by the control circuit 118 based on location data, latitude and/or longitude data, aircraft speed, temperature outside the aircraft, and/or aircraft data.

While in certain examples the control circuitry 118 may make one or more adjustments to a feedback filter and/or a feed-forward filter based on environmental conditions, in certain extreme situations, it may be desirable to completely disable the ANR circuitry and associated feedback filter and/or feed-forward filter. For instance, when rapidly changing environmental conditions such as atmospheric pressure would otherwise render the ANR circuitry unstable, or when one or more components of the headphone system 100 begins to fail, the control circuitry 118 may "turn-off" the ANR circuitry. In one example, the control circuitry 118 is configured to provide a disable control signal to the feedback microphone 104 and the feed-forward microphone 112. Upon receipt of a disable signal the feedback microphone 104 and the feed-forward microphone 112 cease noise detection operations. Accordingly, when the ANR circuitry is disabled the input audio signal is provided directly to the speaker 102 and not combined with the feedback compensating signal and/or the feed-forward compensating signal as otherwise described herein. In various examples, the control circuitry 118 may compare an instantaneous value or a rate of change of the received atmospheric pressure signal to a threshold to determine when to disable the ANR circuitry. In particular, the threshold may be set to the performance limitations of the ANR circuitry relative to atmospheric pressure, among other environmental conditions.

In addition to supporting improved ANR functionality, the one or more environmental sensors provide the benefit of improved operational safety when compared to a typical headphone system. For instance, the control circuit 118 may generate one or more alarms or alerts when certain values are detected by the environmental sensors. For example, the control circuit 118 may compare the pressure signal and/or the altitude signal to an alarm threshold, and generate an alert or an alarm when a value of the pressure signal and/or altitude signal (e.g., a discrete value, an average value, or a rate of change) exceeds the alarm threshold. In many instances, the alarm threshold is much greater than the threshold(s) necessary to switch control settings or transfer functions. That is, the alarm threshold may be set to a value that is only exceeded in extreme situations, such as when cabin pressure is rapidly reduced or altitude is rapidly decreased.

As further illustrated in FIG. 1, in various examples the headphone system 100 may include an oxygen sensor 110. The oxygen sensor 110 may be coupled and in communication with the control circuit 118 via the sensor interface 126 and may provide an oxygen signal based on a measured oxygen level. Similar to the pressure signal and the altitude signal, the control circuit 118 may compare the oxygen signal, an average oxygen signal, or a rate of change of the oxygen signal to an alarm threshold and generate an alert or alarm if the threshold is exceeded.

Irrespective of the sensor type, when the alarm threshold is exceeded, the control circuit 118 may provide one or more alarm signals to the speaker 102, which delivers an audible alarm or alert to the listener. In certain examples, the control circuit 118 may mask other audio signals being reproduced by the speaker 102 while an alarm signal is being delivered to the speaker 102 to ensure that the listener hears the audible alarm. In addition to providing one or more audible alarms, in certain examples the control circuit 118 may also activate one or more display devices of the headphone system 100 or a device in communication with the headphone system 100 (e.g., a mobile phone) when the alarm threshold is exceeded. For instance, the control circuit 118 may activate one or more light emitting diodes (LEDs) within the headphone system 100.

The control circuit 118 shown and described with reference to FIG. 1 may be implemented using hardware, software, or a combination of hardware and software. For instance, in one example, the control circuit 118 is implemented as a software component that is stored within a data store and executed by a processor. In other examples, the control circuit 118 may be an application-specific integrated circuit (ASIC) that is coupled to a processor. Thus, examples of the control circuit 118 are not limited to a particular hardware or software implementation. One example of a control circuit 118 is illustrated and described with reference to FIG. 6.

While shown in FIG. 1 as being separate from a structure of the headphone system 100, in various other examples the control circuit 118 may be integrated within the earpiece 116 of the system 100. For instance, the control circuit 118 may be integrated within a headband or earpiece 116 of the headphone system 100. In certain other examples, the control circuit 118 may be implemented within the audio signal source (e.g., a mobile device) in communication with the data bus 120 along a wired or wireless connection. Similarly, while FIG. 1 illustrates each environmental sensor as being separated from the headphone structure, in certain examples each of the atmospheric pressure sensor 106, altitude sensor 108, and oxygen sensor 110 may be integrated within the headphone structure.

In certain examples, the control circuit 118 may communicate with an on-board aircraft system, and in particular, one or more on-board aircraft system sensors. For instance, the headphone system 100 may include a sensor interface 126 that couples the control circuit 118 to one or more sensors within the on-board aircraft system. Accordingly, in some examples each of the environmental sensors (e.g., the atmospheric pressure sensor 106, the altitude sensor 108, and the oxygen sensor 110) may be integral to the on-board aircraft system and may communicate with the control circuit 118 through the sensor interface 126, which may be a wired or wireless connection. According to these examples, the headphone system 100 may be configured to receive the pressure signal, the altitude signal, the oxygen signal, as well as, additional data and information, from the on-board aircraft system or other hardware external to the headphone system 100. Information not received through the sensor interface 126 may be otherwise received from the on-board aircraft system or other hardware via a communication interface.

For instance, the on-board aircraft system sensors may provide location data (Global Positioning System (GPS) data), atmospheric pressure signal data, altitude signal data, and other aircraft data. In certain examples, the control circuit 118 may adjust the feedback and/or feed-forward filters based on the aircraft data and additional information received from the on-board aircraft system. For example, instead of receiving the atmospheric pressure and/or altitude data from a sensor integrated within the headphone system 100, the headphone system 100 may receive the atmospheric pressure and/or altitude data from the on-board aircraft system itself. In such an example, the headphone system 100 would receive the atmospheric pressure and/or altitude data from the on-board aircraft system at the sensor interface 126 of the control circuit 118, and adjust performance of the headphone system 100 as described above.

Figure 3:
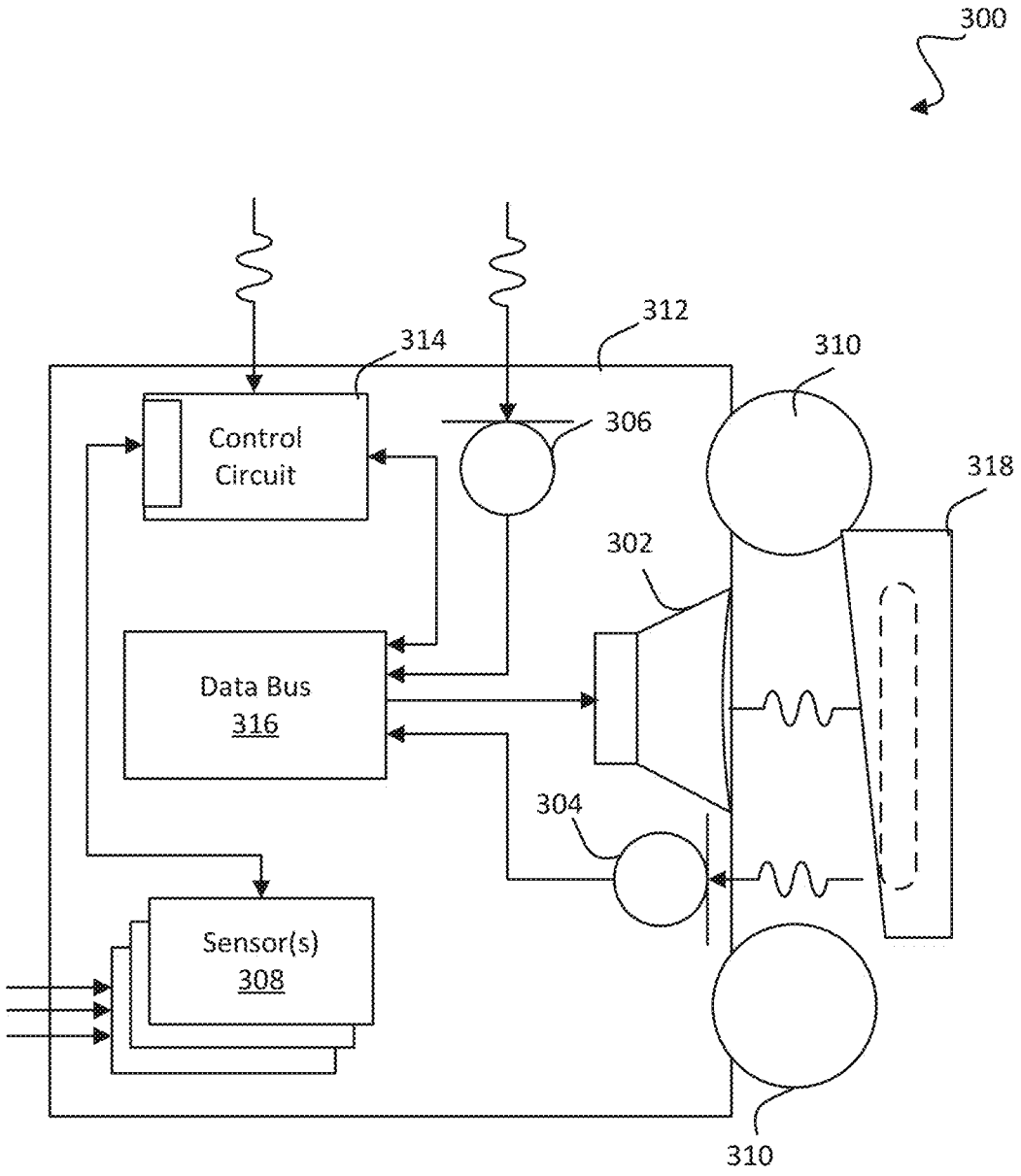
FIG. 3 is a block diagram of another headphone system according to various examples discussed herein.

Turning now to FIG. 3, illustrated is another example of a headphone system 300 according to examples discussed herein. As shown, the headphone system 300 may include many of the same components as the headphone system 100 illustrated in FIG. 1. For instance, the headphone system 300 may include at least one speaker 302, one or more microphones, such as a feedback microphone 304 and a feed-forward microphone 306, one or more environmental sensors 308 (e.g., an atmospheric pressure sensor, an altitude sensor, and/or an oxygen sensor), one or more ear-cushions 310, an earpiece 312, a control circuit 314, and a data bus 316. Moreover, each component of the headphone system 300 of FIG. 3 is illustrated as being integrated within the earpiece 312. For instance, each of the speaker 302, the feedback microphone 304, the feed-forward microphone 306, the atmospheric pressure sensor, the altitude sensor, the oxygen sensor, and/or the control circuit 314 may be integrated within the earpiece 312. While in one example the control circuit 314 and the environmental sensors 308 may be, for example, integrated within a headband or an ear-cup of the earpiece 312, placement of the various components may depend on the particular shape and size of the earpiece 312 as well as the desired aesthetic appearance of the headphone system 300. As illustrated in FIG. 3, in one example the earpiece 312 may be in contact with the ear 318 of a listener at the ear-cushions 310. However, in other examples the ear-cushions 310 may be in contact with the head of the listener, or within the pinna of the ear 318 of the listener.

In various examples, each of the control circuit 314, the feedback microphone 304, the feed-forward microphone 306, the atmospheric pressure sensor, the altitude sensor, and the oxygen sensor may perform operations and processes similar to those discussed above with reference to the control circuit 118, feedback microphone 104, feed-forward microphone 112, atmospheric pressure sensor 106, altitude sensor 108, and oxygen sensor 110, respectively, of FIG. 1. For example, the atmospheric pressure sensor may measure an atmospheric pressure, the altitude sensor may measure an altitude of the headphone system 300 relative to the earth, the oxygen sensor may measure an oxygen level, and the control circuit 314 may adjust a feedback and/or feed-forward filter applied by the control circuit 314 to compensate for one or more effects the measured conditions may have on ANR operations performed by the headphone system 300.

Figure 4:
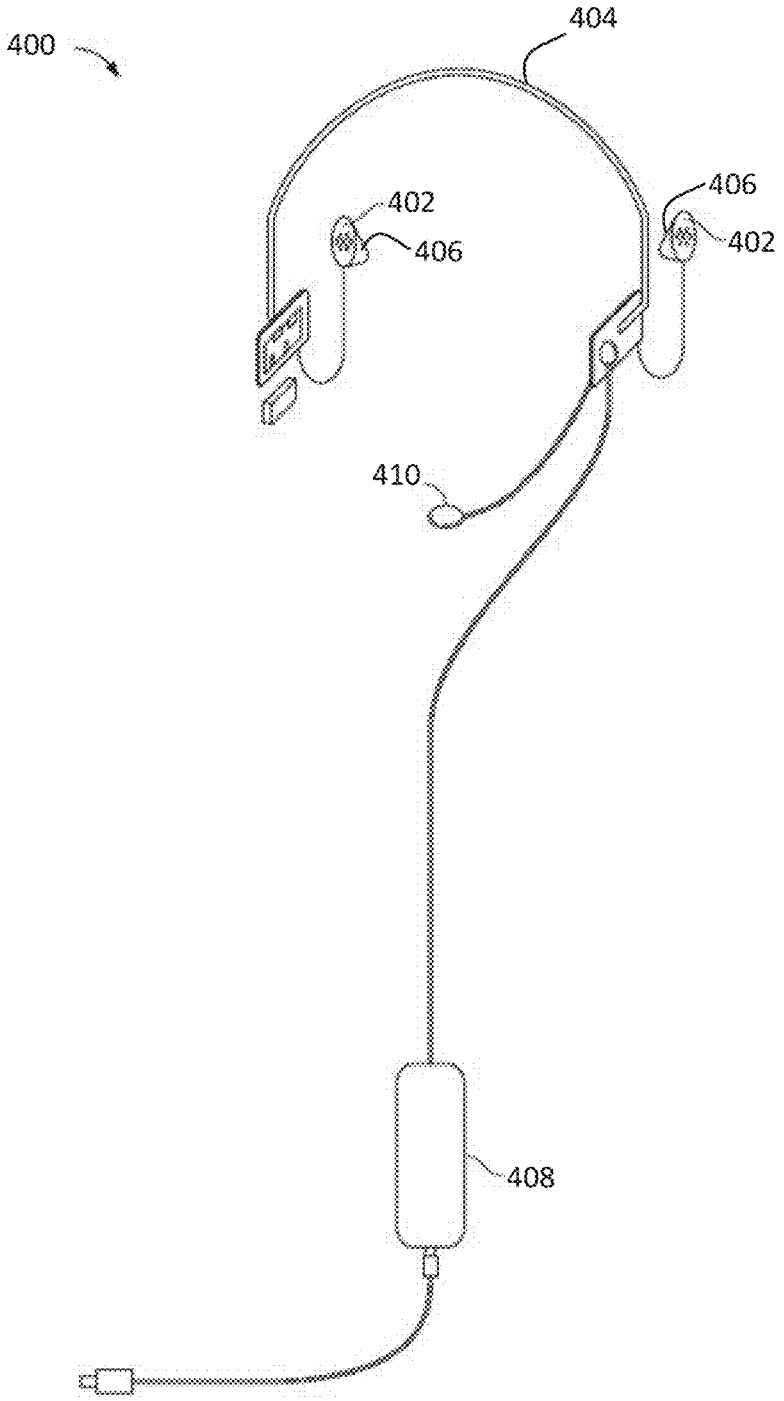
FIG. 4 is an in-ear headphone structure according to various examples discussed herein.

According to various examples, each of the headphone system 100 of FIG. 1 and the headphone system 300 of FIG. 3 has a variety of possible implementations. One example implementation may include an in-ear headphone structure, such as the in-ear structure illustrated in FIG. 4. In particular, FIG. 4 illustrates an external view of an in-ear headphone system 400. In FIG. 4 the headphone system 400 includes earpieces 402 connected by a headband 404. Each earpiece 402 includes an ear cushion 406 and a speaker. Each ear cushion 406 defines an interior volume of the respective earpiece 402. In various examples, each ear cushion 406 substantially seals the ear canal of the listener from external noise to provide passive noise reduction (PNR) to the listener. The ear cushions 406 may include a conformable frusto-conically shaped structure that deflects inwardly when the earpiece 402 is urged into the ear canal of the listener. The frusto-conically shaped structure conforms to the features of the external ear at the transition region between the bowl of the concha and the ear canal.

It is appreciated that the headphone system 400 may further include a control circuit 408, one or more feedback microphones or feed-forward microphones (not shown), and a boom microphone 410. The feed-forward microphone may be disposed on an external portion of the earpiece 402 to detect external noise, and the feedback microphone may be disposed in the interior volume of the earpiece 402 proximate the speaker. It is appreciated that other arrangements of the feed-forward microphone, the feedback microphone, and the speaker may be employed based on the particular application. In addition, the shape and size of the earpiece 402 may be altered based on the desired design.

The construction of the headphone system 400 may be altered based on the particular implementation. For example, the headphone system 400 may be constructed as a mono headset and employ only one earpiece 402. Further, the headphone system 400 may include a headband that attaches behind a head of a wearer, or may omit the headband 404 altogether. Accordingly, the headphone system 400 is not limited to any particular implementation.

Figure 5:
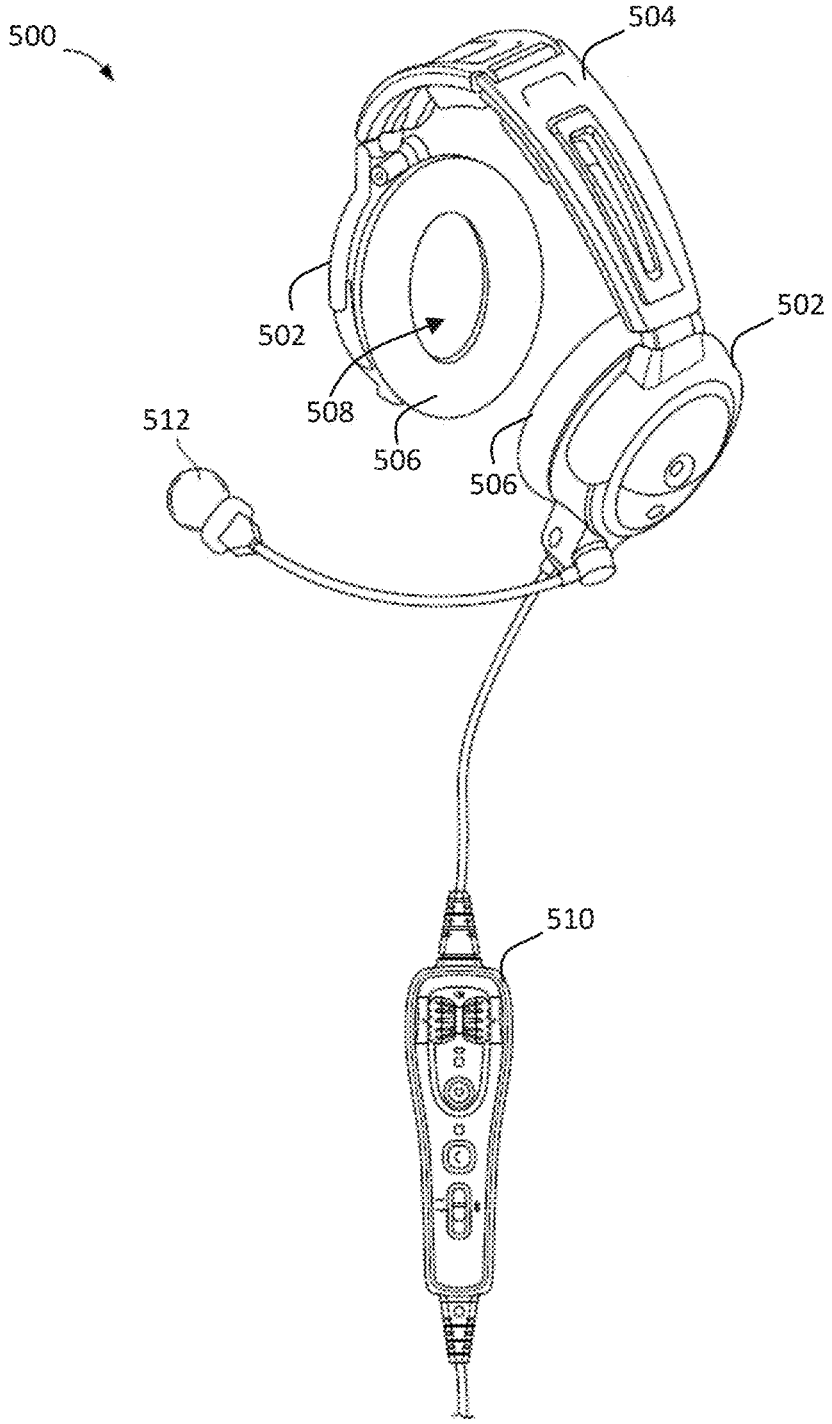
FIG. 5 is an over-the-ear headphone structure according to various examples discussed herein.

In certain other examples, the headphone system 100 or the headphone system 300 may be constructed to include an over-the-ear or an around-the-ear headphone structure. FIG. 5 illustrates one example of an around-the-ear type headphone system 500. In FIG. 5 the headphone system 500 includes earpieces 502 connected by a headband 504. Each earpiece 502 includes an ear cushion 506 and a speaker. Each ear cushion 506 defines an interior volume 508 of the respective earpiece 502. It is appreciated that the headphone system 500 may further include a control circuit 510, one or more feedback microphones or feed-forward microphones (not shown), and a boom microphone 512. The feed-forward microphone may be disposed on an external portion of the earpiece 502 to detect external noise, and the feedback microphone may be disposed in the interior volume 508 of the earpiece 502 proximate the speaker. It is appreciated that other arrangements of the feed-forward microphone, the feedback microphone, and the speaker may be employed based on the particular application. In addition, the shape and size of the earpiece 502 may be altered based on the desired design. For example, a smaller earpiece 502 may be employed in on-ear headset implementations as opposed to around-the-ear headset implementations.

The construction of the headphone system 500 may be altered based on the particular implementation. For example, the headphone system 500 may be constructed as a mono headset and employ only one earpiece 502 attached to the headband 504. The control circuit 510 is illustrated as including a user interface that allows the control circuit 510 to communicate with an external entity, such as a user. Examples of the components that may be employed within the user interface include buttons, switches, light-emitting diodes, touch screens, and displays, to name a few examples. Accordingly, the headphone system 500 is not limited to any particular implementation.

Figure 6:
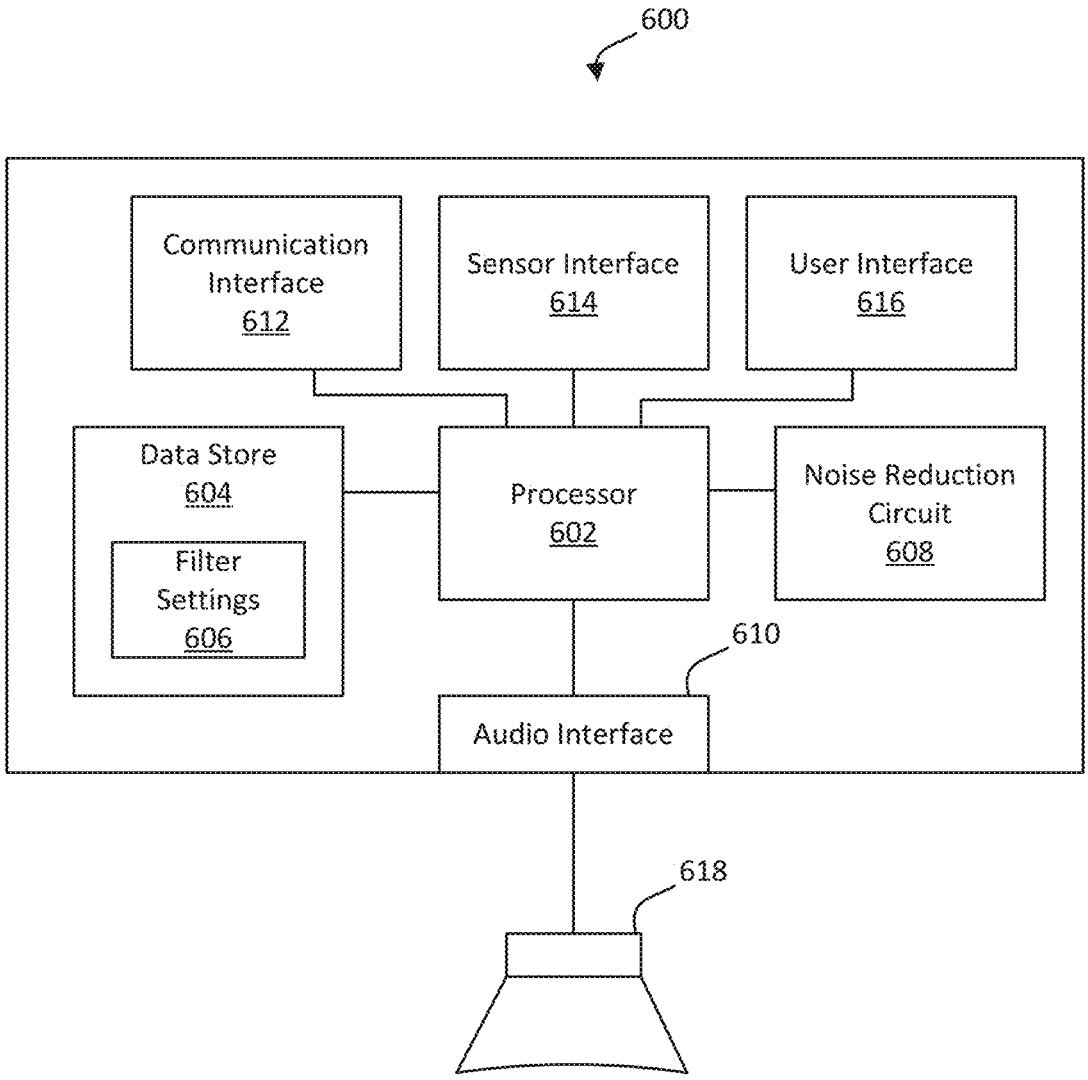
FIG. 6 is a block diagram of a control circuit according to various examples discussed herein.

As discussed above with reference to FIG. 1 and FIG. 3, in various examples the headphone system 100 and the headphone system 300 each include a control circuit 118, 314 in communication with at least one speaker 102, 302. FIG. 6 illustrates an example of a control circuit 600 that may be included within the headphone system 100 of FIG. 1 and/or the headphone system 300 of FIG. 3. The control circuit 600 may include a processor 602, a data store 604 (including filter settings 606 and/or transfer functions, among other information), a noise reduction circuit 608 (also referred to herein as "ANR circuitry"), an audio interface 610, a communication interface 612, a sensor interface 614, and a user interface 616. While not explicitly illustrated in FIG. 6, in certain examples the control circuit 600 may be coupled to a power source, such as a rechargeable battery, and/or a receptacle configured to receive one or more replaceable power sources (e.g., disposable batteries). The power source delivers power to the one or more components of the control circuit 600, as well as other components of the corresponding headphone system.

In FIG. 6, the processor 602 is coupled to the data store 604, the noise reduction circuit 608, and the various interfaces. The processor 602 executes a series of instructions that retrieves data (e.g., the filter settings 606) from the data storage 604. The data storage 604 may include a computer readable and writeable nonvolatile data storage medium configured to store non-transitory instructions and data. The medium may, for example, be optical disk, magnetic disk or flash memory, among others, and may be permanently affixed to, or removable from, the headphone structures shown in FIG. 1 and FIG. 3.

According to certain examples, the noise reduction circuit 608 is configured to perform the various acts and processes discussed herein to actively cancel external noise and/or residual noise. In particular, the noise reduction circuit 608 may apply a feedback filter to provide a feedback compensating signal and apply a feed-forward filter to provide a feed-forward compensating signal. The feedback compensating signal and the feed-forward compensating signal may be combined with an input audio signal to generate a noise-corrected driver signal that is delivered to a speaker 618 to provide acoustic energy to a listener. The noise reduction circuit 608 may be implemented using hardware, software, or a combination of hardware and software. For example, in one instance, the noise reduction circuit 608 is implemented as a software component that is stored in the data store and executed by the processor 602. However, in other examples the noise reduction circuit 608 may be an application-specific integrated circuit (ASIC) that is coupled to the processor 602. Accordingly, the noise reduction circuit 608 is not limited to one particular hardware and/or software implementation.

As discussed with reference to at least FIG. 1, in various examples the filter settings 606 include one or more sets of settings for the noise reduction circuit 608, and in particular, the feedback filter and/or the feed-forward filter. Each set of filter settings 606 includes instructions for the control circuit 600 to optimize ANR performance for a given atmospheric pressure and/or altitude measurement. Each set of filter settings 606 may include an identifier that the control circuit 600 may reference to select the particular set of filter settings 606. As also described herein, the filter settings 606 may be indexed by the identifier in a look-up table, or other suitable indexing structure.

In various examples, the control circuit 600 includes several interface components, such as the audio interface 610, the communication interface 612, the sensor interface 614, and the user interface 616 illustrated in FIG. 6. Each of the interface components is configured to exchange, e.g., send or receive, data with other components of a headphone system, or other devices in communication with the headphone system. In certain examples, the components may include buttons, switches, LEDs, microphones, speakers, and/or antennas, to name a few. According to various examples, the interface components may include hardware components, software components, or a combination of hardware and software components.

In certain examples, the audio interface 610 is coupled to one or more acoustic transducers, such as the illustrated speaker 618. The control circuit 600 (e.g., the noise reduction circuit 608) generates a driver signal based on a received input audio signal and the feedback compensating signal and/or feed-forward compensating signal. The driver signal is provided to the speaker 618 via the audio interface 610. While not illustrated in FIG. 6, the control circuit 600 may further include audio signal processing circuitry such as volume control circuitry, dynamic equalization circuitry, or other audio circuitry. Such circuitry may receive and process the input audio signal before providing the driver signal to the speaker 618 through the audio interface 610. In some instances the functionality of the audio signal processing circuitry may be incorporated within the audio interface 610.

In various examples, the components of the communication interface 612 couple the processor 602 to other devices, such as an audio signal source or an on-board aircraft system. In certain instances, the communication interface 612 allows the processor 602 to receive an audio signal from the audio signal source, which may include for example, a cellular phone, a portable media player, a computer-enabled watch, a personal computer, and/or one or more components of the on-board aircraft system, such as a pilot's radio and/or navigation system. The communication interface 612 may support any of a variety of standards and protocols including, for example, BLUETOOTH® and/or IEEE 802.11. The processor 602 may further perform one or more pairing processes to, for example, initially establishing a communication link between the communication interface 612 and the other devices.

The user interface 616 shown in FIG. 6 may include a combination of hardware and/or software components that allow a corresponding headphone system in which the control circuit 600 is incorporated to communicate with an external entity, such as a user. These components may be configured to receive information from actions such as physical movement and/or verbal intonation. Examples of the components that may be employed within the user interface 616 include buttons, switches, light-emitting diodes, touch screens, displays, stored audio signals, voice recognition, or an application on a computer-enabled device in communication with the control circuit 600.

Thus, the various system interfaces allow the control circuit 600 to interoperate with a wide variety of devices in various contexts. It is appreciated that various interfaces may be removed from the control circuit 600 based on the particular construction and features of the headphone system. In addition, particular components may be adjusted or added to suit the particular construction of headphone system.

Figure 7:
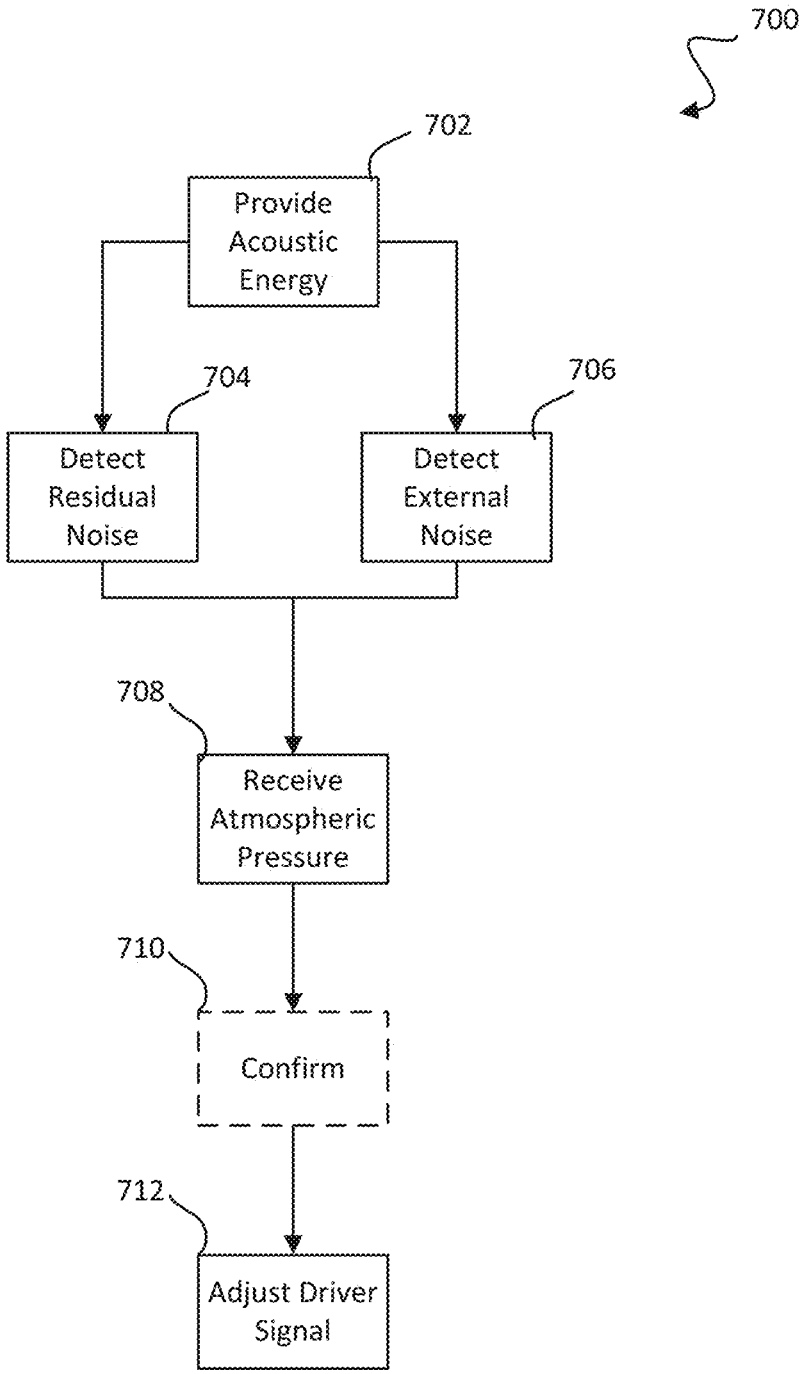
FIG. 7 is a flow diagram illustrating a process for operating a headphone system, according to various examples discussed herein.

As described above with reference to at least FIG. 1, several examples perform processes that improve active noise reduction based on atmospheric pressure and/or altitude data. In some examples, these processes are executed by a headphone system, such as the headphone system 100 described above with reference to FIG. 1 or the headphone system 300 described with reference to FIG. 3. One example of such a process 700 is illustrated in FIG. 7. Process 700 includes the acts of providing acoustic energy to a listener based on a received driver signal, detecting at least one of external noise and residual noise and generating a corresponding microphone signal, measuring an environmental condition, and adjusting a driver signal for the acoustic energy based on at least the environmental condition to compensate for the external noise and/or residual noise. The process 700 of FIG. 7 is described with continuing reference to the headphone system 100 illustrated in FIG. 1 and the block diagram illustrated in FIG. 2.

In act 702, the process 700 may include providing acoustic energy from a speaker of a headphone system to an acoustic volume based on a driver signal received at the speaker. For instance, the process 700 may include converting the driver signal to corresponding acoustic energy, which delivers audio content to a listener positioned proximate the headphone system. In at least one example, the process 700 may include the act of receiving an input audio signal from an audio signal source, and generating the driver signal for the speaker based at least in part on the input audio signal. Such processes are further discussed below with reference to act 712.

In act 704, the process 700 may include detecting at least the residual noise within the acoustic volume and generating a feedback audio signal indicative of the residual noise, with a feedback microphone positioned within the headphone system. Similarly, in act 706 the process 700 may include detecting external noise and generating a feed-forward audio signal indicative of the external noise, with a feed-forward microphone positioned within the headphone system. While illustrated as including both acts 704 and 706 in one example, in certain examples, the process 704 may include just act 704 or just act 706.

In particular examples, the feedback microphone may be positioned proximate the ear of the listener to measure the acoustic energy and residual noise as it is perceived by the listener. In various examples, the process 700 may include providing the feedback audio signal to a control circuit of the headphone system in a feedback loop. Similarly, the process 700 may include providing the feed-forward audio signal to a control circuit of the headphone system in a feed-forward loop. Each of the feedback audio signal and feed-forward audio signal may be filtered to provide a feedback compensating signal and a feed-forward compensating signal, respectively. That is, the process 700 may include applying a feedback filter to the feedback audio signal to provide a feedback compensating signal and/or applying a feed-forward filter to the feed-forward audio signal to provide a feed-forward compensating signal. In particular, filtering each of the feedback audio signal and a feed-forward audio signal may adjust the feedback audio signal and feed-forward audio signal to compensate for the effects of the residual noise and the external noise on the audio content of the audio signal. As further discussed below, the process 700 may include combining the feedback compensating signal and the feed-forward compensating signal with the input audio signal to provide a noise-adjusted driver signal.

As discussed above, in some instances changing environmental conditions may have an impact on the performance of the headphone system, and in particular, ANR circuitry (e.g., feedback filter(s) and/or feed-forward filter(s)). Accordingly, in act 708, the process 700 may include receiving an environmental condition, such as an atmospheric pressure, from one or more environmental sensors. In certain examples, the process 700 may further include the act of measuring the atmospheric pressure, and in particular, measuring an instantaneous atmospheric pressure value, periodically measuring an atmospheric pressure value, or continuously measuring an atmospheric pressure value, prior to receiving the environmental condition.

In response to receiving the pressure signal, the process 700 may include adjusting the driver signal based at least in part on the feedback and/or feed-forward audio signal and the pressure signal (act 712). In particular, the process 700 may include making one or more adjustments to the ANR circuitry (e.g., feedback filter(s) and/or feed-forward filter(s)) to effect a change in the diver signal and the acoustic energy delivered to the listener. Specifically, the process 700 may include adjusting the feedback filter(s) and/or feed-forward filter(s) to compensate for the effects of the measured atmospheric pressure on ANR operations.

Adjustments to the feedback and/or feed-forward filters may be performed continuously, and in real-time, with the receipt of the pressure signal. While in various implementations, any suitable technique may be used to adjust the feedback and/or feed-forward filters, in certain examples the process 700 includes adjusting a transfer function and/or filter coefficients of the feedback and/or feed-forward filter based on the pressure signal to compensate for the effects the measured atmospheric pressure may have on the ANR performance. For instance, the process 700 may include adjusting a filter coefficient that, in turn, defines one or more of a gain, phase, or frequency response of the corresponding feedback or feed-forward filter. Based on one or more values of the pressure signal, the process 700 may include selecting and applying a filter coefficient set that defines one or more of the gain, phase, or frequency response.

In certain examples, process 700 may include selecting one or more filter settings based on a given pressure signal. For instance, the filter settings may specify a transfer function or a set of filter coefficients for the feedback filter and/or feed-forward filter. As discussed herein, based on the received signal(s) from the environmental sensor(s), the process 700 may include selecting the filter settings that best cancel the external noise and residual noise given the detected environmental conditions, while also operating the ANR system in a manner that reduces or prevents the system from being rendered unstable. Accordingly, the process 700 may include selecting an appropriate feedback filter coefficient set from among a plurality of feedback filter coefficient sets, and/or may include selecting an appropriate feed-forward filter coefficient set from among a plurality of feed-forward filter coefficient sets. Once the appropriate coefficient sets have been retrieved, the process 700 may include applying the appropriate filter coefficient sets to the corresponding feedback filter or feed-forward filter to adjust the gain, phase, and/or frequency response thereof.

As discussed above, in many examples the control circuit 118 of FIG. 1 makes one or more feedback filter and/or feed-forward filter adjustments when an instantaneous value of the atmospheric pressure or a rate of change of the atmospheric pressure exceeds one or more thresholds. In many instances, these thresholds are set at a level that indicates when environmental conditions necessitate an adjustment to current ANR operations. In certain examples, the process 700 may include delaying these adjustments until an instantaneous value of a measured altitude, or a rate of change thereof, also exceeds one or more similar thresholds. That is, the process 700 may include waiting until both a value of atmospheric pressure and a value of a measured altitude exceed a corresponding threshold prior to adjusting the feedback filter and/or feed-forward filter as described herein. Such an implementation adds an additional level of stability to the headphone system.

Referring to act 710, in certain examples the process 700 may include the act of receiving an altitude signal and confirming that one or more adjustments to ANR operations of the headphone system (e.g., headphone system 100) is appropriate given current environmental conditions. That is, act 710 may include using one or more signals from the other environmental sensors (e.g. the altitude sensor) to confirm that current environmental conditions demand an adjustment to the ANR circuitry (e.g., the feedback filter 200 and/or the feed-forward filter 202 illustrated in FIG. 2).

According to various examples, the process 700 may further include measuring an altitude of the headphone system relative to the earth and generating a corresponding altitude signal. Similar to the atmospheric pressure measurements, altitude measurements may be discrete, periodic, or continuous, depending on the specific implementation. As discussed herein with reference to at least act 712, the process 700 may include making one or more feedback filter and/or feed-forward filter adjustments when an instantaneous value of the atmospheric pressure or a rate of change of the atmospheric pressure exceeds one or more thresholds. In certain examples, in act 710 the process may include delaying these adjustments until an instantaneous value of the altitude, or a rate of change of the altitude, also exceeds one or more similar thresholds. That is, the process 700 may include delaying adjustment until both a value of atmospheric pressure and a value of the altitude exceed a corresponding threshold. While discussed in one example as an instantaneous value or a rate of change of an altitude signal, in various other examples similar processes may be executed based on location data, latitude and/or longitude data, aircraft speed, temperature outside the aircraft, and aircraft data, among various other environmental data.

While not explicitly shown in FIG. 7, the process 700 may further include various other acts, such as measuring an oxygen level, providing a corresponding oxygen signal, comparing the oxygen signal to an oxygen threshold, and providing an alarm signal when the oxygen signal exceeds the oxygen threshold, to name a few. Such acts are further described with reference to the audio system of FIG. 1.

As such, various aspects and examples discussed herein are directed to a headphone system that includes one or more sensors to monitor environmental conditions and/or a state of an aircraft. Signals received from each sensor of the headphone system are used to determine the appropriate settings for an active noise reduction circuit of the headphone system, and adjust delivered audio content appropriately. That is, the headphone system may select one or more ANR filter settings for the headphone system to accommodate for one or more influences that the environmental conditions and/or state of the aircraft may have on ANR performance. Various aspects and examples provide improved noise cancellation functionality in a way that is not currently available in ANR headphone systems. While described herein primarily within the context of a headphone system, aspects and features described herein may be incorporated within other audio systems.

Having described above several aspects of at least one implementation, it is to be appreciated various alterations, modifications, and improvements will readily occur to those skilled in the art. Such alterations, modifications, and improvements are intended to be part of this disclosure and are intended to be within the scope of the description. Accordingly, the foregoing description and drawings are by way of example only, and the scope of the disclosure should be determined from proper construction of the appended claims, and their equivalents.

What is claimed is:

1. An aviation headphone system comprising:

an earpiece including a speaker;

at least one feed-forward microphone coupled to the earpiece and configured for use in generating a feed-forward audio signal, such that a feed-forward filter applied to the feed-forward audio signal provides a feed-forward compensating signal that compensates for external noise;

at least one feedback microphone coupled to the earpiece and configured for use in generating a feedback audio signal, such that a feedback filter applied to the feedback audio signal provides a feedback compensating signal that compensates for residual noise, and the feed-forward and feedback compensating signals can be used to generate a noise-corrected driver signal to be output by the speaker;

an oxygen sensor configured to provide an oxygen signal based on a measured oxygen level; and a control circuit in communication with the oxygen sensor, the control circuit configured to compare at least one of i) the oxygen signal, ii) an average oxygen signal based on the oxygen signal, or iii) a rate of change of the oxygen signal to an alarm threshold, and in response to exceeding the alarm threshold, generate an alert or alarm, wherein the control circuit is further configured to communicate with an on-board aircraft system.

2. The aviation headphone system of claim 1, wherein the control circuit is at least partially integrated within the earpiece.

3. The aviation headphone system of claim 1, wherein the control circuit is separate from the earpiece.

4. The aviation headphone system of claim 1, wherein the control circuit is implemented as a software component that is stored within a data store and executed by a processor.

5. The aviation headphone system of claim 1, wherein the control circuit is further configured to, in response to exceeding the alarm threshold, provide one or more alarm signals to the speaker.

6. The aviation headphone system of claim 5, wherein the control circuit is further configured to mask other audio signals being reproduced by the speaker when providing the one or more alarm signals to the speaker.

7. The aviation headphone system of claim 1, wherein the control circuit is further configured to, in response to exceeding the alarm threshold, activate one or more display devices in communication with the headphone system.

8. The aviation headphone system of claim 1, wherein the earpiece is an in-ear headphone structure.

9. The aviation headphone system of claim 1, wherein the earpiece is an over-the ear or around-the-ear headphone structure.

10. The aviation headphone system of claim 1, further comprising an atmospheric pressure sensor configured to provide a pressure signal based on a measured atmospheric pressure.

11. The aviation headphone system of claim 10, wherein at least one of the feed-forward or feedback filters is adjusted based on the pressure signal.

12. The aviation headphone system of claim 1, further comprising an altitude sensor configured to provide an altitude signal based on a measured altitude of the headphone system relative to earth.

13. The system of claim 1, wherein the control circuit being configured to communicate with the on-board aircraft system includes the control circuit being configured to communicate with one or more on-board aircraft system sensors.

14. The system of claim 1, wherein the control circuit is further configured to adjust the feedback filter and/or feed-forward filter based on aircraft data received from the on-board aircraft system.

15. A method of operating an aviation headphone system having an earpiece that includes a speaker, the method comprising:

generate a feed-forward audio signal using at least one feed-forward microphone coupled to the earpiece;

apply a feed-forward filter to the feed-forward audio signal to provide a feed-forward compensating signal that compensates for external noise;

generate a feedback audio signal using at least one feedback microphone coupled to the earpiece;

apply a feedback filter to the feedback audio signal to provide a feedback compensating signal that compensates for residual noise;

generate a noise-corrected driver signal using the feed-forward and feedback compensating signals;

using the speaker, output the noise-corrected driver signal;

using an oxygen sensor, provide an oxygen signal based on a measured oxygen level;

compare at least one of i) the oxygen signal, ii) an average oxygen signal based on the oxygen signal, or iii) a rate of change of the oxygen signal to an alarm threshold; and in response to exceeding the alarm threshold, generate an alert or alarm, wherein the aviation headphone system is configured to communicate with an on-board aircraft system.

16. The method of claim 15, further comprising:

in response to exceeding the alarm threshold, provide one or more alarm signals to the speaker.

17. The method of claim 16, further comprising:

mask other audio signals being reproduced by the speaker when providing the one or more alarm signals to the speaker.

18. The method of claim 15, further comprising:

in response to exceeding the alarm threshold, activate one or more display devices in communication with the headphone system.

19. The method of claim 15, wherein the earpiece is an in-ear headphone structure.

20. The method of claim 15, wherein the earpiece is an over-the ear or around-the-ear headphone structure.

* * * * *